US005128694A

United States Patent [19]

Kanayama

[11] Patent Number: 5,128,694

[45] Date of Patent: Jul. 7, 1992

[54] HEAD FOR INK-JET PRINTER

[75] Inventor: Yoshio Kanayama, Nabari, Japan

[73] Assignee: Sharp Kabushiki Kaisha, Osaka, Japan

[21] Appl. No.: 533,687

[22] Filed: Jun. 5, 1990

[30] Foreign Application Priority Data

Jun. 9, 1989 [JP] Japan ..... 1-147090

[51] Int. Cl.[5] ..... B41J 2/045

[52] U.S. Cl. ..... 346/140 R

[58] Field of Search ..... 346/140 PD, 75, 140; 310/328, 364-367

[56] References Cited

U.S. PATENT DOCUMENTS

| | | | |
|---|---|---|---|
| 4,536,097 | 8/1985 | Nilsson | 346/75 |
| 4,752,789 | 6/1988 | Maltsev | 346/140 R |
| 4,759,107 | 7/1988 | Ogawa et al. | 29/25.35 |
| 4,812,698 | 3/1989 | Chida et al. | 310/330 |
| 4,819,014 | 4/1989 | Yasuhara et al. | 346/140 R |
| 4,845,399 | 7/1989 | Yasuda et al. | 310/366 |
| 4,937,597 | 6/1990 | Yasuhara et al. | 346/140 R |

FOREIGN PATENT DOCUMENTS

| | | |
|---|---|---|
| 0095911 | 12/1983 | European Pat. Off. . |
| 3630206A1 | 3/1987 | Fed. Rep. of Germany . |
| 63-92745 | 6/1988 | Japan . |

*Primary Examiner*—Benjamin R. Fuller
*Assistant Examiner*—Alrick Bobb
*Attorney, Agent, or Firm*—David G. Conlin; Robert M. Asher

[57] ABSTRACT

A head for an ink-jet printer includes a plurality of ink chambers arranged in parallel on a plane, a plurality of nozzles communicated with each of the chambers, and a piezoelectric element. The piezoelectric element has a laminated structure in which at least one piezoelectric layer and at least two electrode layers sandwiching the piezoelectric layer are laminated, and is attached to the chambers so as to overlie the chambers with the layers being in parallel to the plane of arrangement of the chambers. The piezoelectric element includes a plurality of pressure portions and a plurality of slits. The slits face the chambers and deepen in a direction perpendicular to the plane of arrangement of the chamber so as to divide the pressure portions from other portion or the piezoelectric element such that each of the pressure portions attaches to each of the chambers at an area defined by the slits and that each of the pressure portions includes the laminated structure. Each of the pressure portion presses each of the chambers at the attaching area by an expansion due to a piezoelectric effect when an electric voltage is applied across the electrode layers in each of the pressure portions.

8 Claims, 2 Drawing Sheets

HEAD FOR INK-JET PRINTER

BACKGROUND OF THE INVENTION

1. Field of the Invention

The present invention relates to a head for an ink-jet printer.

2. Description of the Related Art

Ink-jet printers are known as one kind of terminal equipment for computers. FIG. 1 is a schematic front elevational view showing a conventional head for an ink-jet printer. As shown in FIG. 1, the illustrated head has a glass container 1 provided with two recesses, a first piezoelectric element 5*a*, and a second piezoelectric element 5*b*. A first stainless plate 2*a* is disposed to cover one recess of the glass container 1, and this recess and the first stainless plate 2*a* form a first ink chamber 3*a*. The other recess is covered by a second stainless plate 2*b*, and this recess and the second stainless plate 2*b* form a second ink chamber 3*b*. The first ink chamber 3*a* is formed to communicate with a first nozzle 4*a*, while the second ink chamber 3*b* is formed to communicate with a second nozzle 4*b*. A first piezoelectric element 5*a* is fixed to the first stainless plate 2*a*, while a second piezoelectric element 5*b* is fixed to the second stainless plate 2*b*. As described above, the head in FIG. 1 includes two nozzle units disposed in parallel, each of which consists of the chamber, the piezoelectric element, the stainless plate and the nozzle.

The operation of the conventional head will be explained below with reference to FIG. 2, which is a schematic front elevational view showing the head of FIG. 1.

In its operation, a voltage is applied across the first piezoelectric element 5*a* to cause it to contract in the direction indicated by an arrow A. The first stainless plate 2*a* fixed to the first piezoelectric element 5*a* is, in turn, deflected in the direction indicated by an arrow B. As the first stainless plate 2*a* is deflected in the direction of the arrow B, pressure is applied to the ink in the first ink chamber 3*a* and a jet of ink droplets is expelled from the first nozzle 4*a*. Each of the first nozzle 4*a* and the second nozzle 4*b* is made to independently perform the above-described operation, thereby enabling information to be recorded.

A head for an ink-jet printer is constructed such that a plurality of nozzle units, each of which is similar to the nozzle unit shown in FIG. 1, are arranged in parallel. In such a construction, since each ink chamber is provided with a piezoelectric element in the above-described manner, the production of the head requires time-consuming processes to individually equip the piezoelectric element to each ink chambers and so on.

SUMMARY OF THE INVENTION

It is therefore an object of the present invention to provide a head for an ink-jet printer which can be produced at high productivity.

To achieve the above object, according to the present invention, there is provided a head for an ink-jet printer includes a plurality of ink chambers arranged in parallel on a plane, a plurality of nozzles communicated with each of the chambers, and a piezoelectric element. The piezoelectric element has a laminated structure in which at least one piezoelectric layer and at least two electrode layers sandwiching the piezoelectric layer are laminated, and is attached to the chambers so as to overlie the chambers with the layers being in parallel to the plane of arrangement of the chambers. The piezoelectric element includes a plurality of pressure portions and a plurality of slits. The slits face the chambers and deepen in a direction perpendicular to the plane of arrangement of the chamber so as to divide the pressure portions from other portion of the piezoelectric element such that each of the pressure portions attaches to each of the chambers at an area defined by the slits and that each of the pressure portions includes the laminated structure. Each of the pressure portion presses each of the chambers at the attaching area by an expansion due to a piezoelectric effect when an electric voltage is applied across the electrode layers in each of the pressure portions.

In the head of the present invention, each of the pressure portion includes the laminated structure of the piezoelectric layer and the electrode layers and presses the chamber by an expansion due to the piezoelectric effect when an electric voltage is applied across the electrode layers in each of the pressure portion. Then, the ink in the pressed chamber is pressurized, thus producing a jet of ink droplets from the nozzle corresponding to the pressure portion. All of the pressure portions, thus operating individually, are included in the single piezoelectric element and divided from other portion of the piezoelectric element by the slits.

Accordingly, it is not necessary to mount a plurality of piezoelectric elements with respect to individual ink chambers one by one as in the conventional manners. Thus, the productivity of the head can be improved.

The above and other objects, features and advantages of the present invention will be apparent from the following description of a preferred embodiment of the invention with reference to the accompanying drawings.

DESCRIPTION OF THE PREFERRED EMBODIMENT

Figure 1:
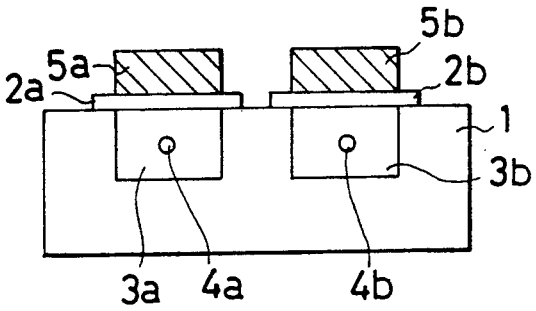
Fig. 1 PRIOR ART
FIG. 1 is a schematic front elevational view showing a conventional head for an ink-jet printer in one state.
Figure 2:
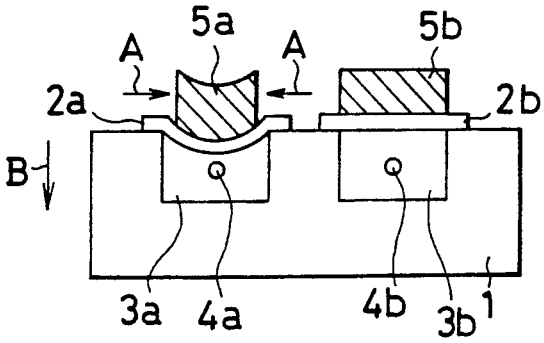
Fig. 2 PRIOR ART
FIG. 2 is a schematic front elevational view showing the head of FIG. 1 in another state.
Figure 3:
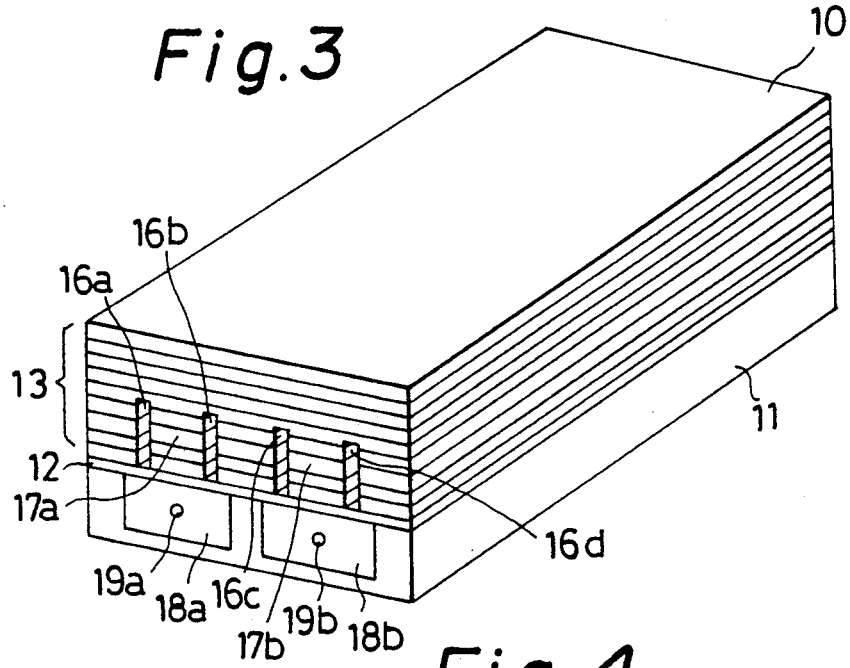
FIG. 3 is a schematic perspective view showing one embodiment of the present invention.
Figure 4:
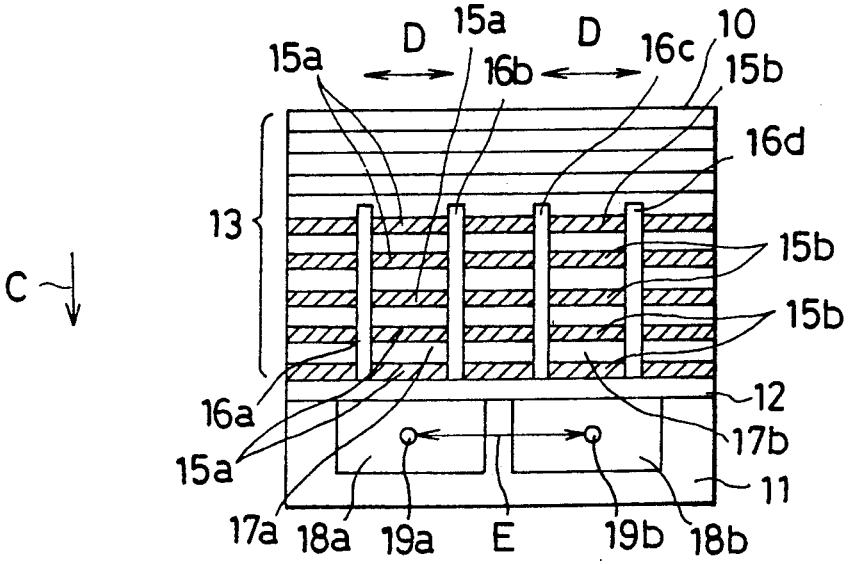
FIG. 4 is a schematic front elevational view showing the embodiment of FIG. 3.

A preferred embodiment of the present invention will be described below with reference to the accompanying drawing. FIG. 3 is a schematic perspective view showing one embodiment of a head for an ink-jet printer according to the present invention. FIG. 4 is a schematic front elevational view showing the embodiment of FIG. 3. Referring to FIG. 3 and 4, a head 10 has a container 11 provided with two recesses and a piezoelectric element 13 which serves a piezoelectric vertical effect. The container 11 is made of, for example, glass.

The piezoelectric element 13 is shaped in a rectangular parallelpiped block and has a laminated structure in which a plurality of layers of piezoelectric material and a plurality of layers of electrodes 15*a*, 15*b* are laminated as shown in FIG. 4.

The layers of piezoelectric material of the piezoelectric element 13 are, for example, made of lead titanate zirconate. The layers of electrodes 15*a*, 15*b* are, for example, made of nickel. The piezoelectric element 13 has slits 16*a*, 16*b*, 16*c* and 16*d* which extend in the direction perpendicular to the surface of the sheet of FIG. 4. An area defined by the slits 16*a* and 16*b* forms a first pressure portion 17*a*, and a set of first electrodes 15*a* is disposed in the first pressure portion 17*a*. An area defined by the slits 16*c* and 16*d* forms a second pressure portion 17*b*, and a set of second electrodes 15*b* is disposed in the second pressure portion 17*b*.

An elastic plate 12 is mounted above the two recesses of the container 11. The plate 12 is made of, for example, glass, stainless or the like. One recess of the container 11 and the plate 12 form a first ink chamber 18*a*, while the other recess of the container 11 and the plate 12 form a second ink chamber 18*b*. The first ink chamber 18*a* communicates with a first nozzle 19*a*, while the second ink chamber 18*b* communicates with a second nozzle 19*b*.

A method of producing the piezoelectric element 13 will now be explained with reference to FIGS. 5*a* to 5*c*.

Figure 5A:
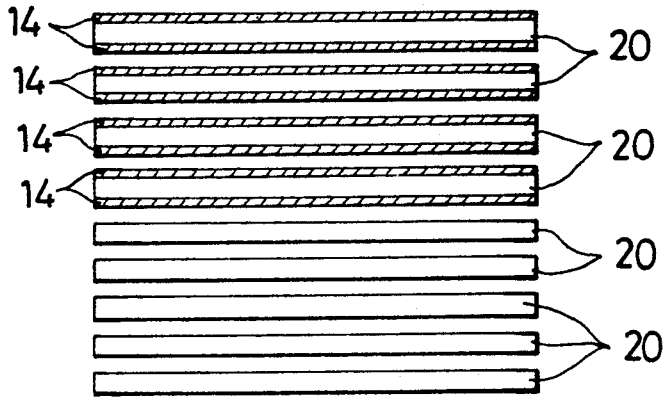
FIGS. 5*a* to 5*c* are process diagrams which serve to illustrate the sequence of a method of producing a piezoelectric element for use in the embodiment of FIG. 3.

As shown in FIG. 5*a*, nine green sheets 20 made of, for example, lead titanate zirconate are stacked. Electrodes 14 are printed beforehand on opposite surfaces of each of the upper four green sheets 20 so as to form the layers of electrodes.

Figure 5B:
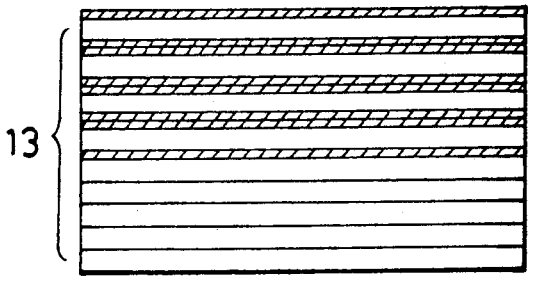

As shown in FIG. 5*b*, the nine stacked green sheets 20 are sintered to form the piezoelectric element 13.

Figure 5C:
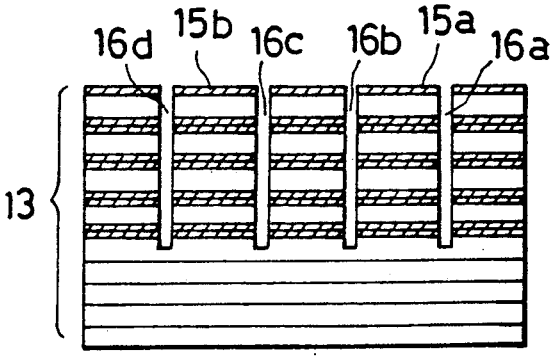

As shown in FIG. 5*c*, the slits 16*a* to 16*d* are formed in the piezoelectric element 13 in the direction perpendicular to the surface of the sheet of the drawing. Thus, the electrodes 14 are separated into the set of first electrodes 15*a* and the set of second electrodes 15*b*. The piezoelectric element 13 is produced through the above-described process.

The operation of the head 10 including the piezoelectric element 13 will now be explained with reference to FIG. 4. When a voltage is applied across the first electrodes 15*a*, since the piezoelectric element 13 exhibits a piezoelectric vertical effect, the first pressure portion 17*a* expands in the direction indicated by an arrow C, that is, in the direction perpendicular to the surfaces of the electrodes 15*a*. Thus, the plate 12 is deflected in the direction of the arrow C to apply pressure to the ink in the first ink chamber 18*a*. When the first ink chamber 18*a* is pressed, a jet of ink droplets is expelled from the first nozzle 19*a*.

The second pressure portion 17*b* is operated in the same manner as the first pressure portion 17*a* by use of the electrodes 15*b*.

Since the piezoelectric element 13 used in the above-described embodiment has a laminated structure, the amount of displacement of the piezoelectric element 13 can be increased in proportion to the number of lamination. Accordingly, in the first and second pressure portions 17*a* and 17*b*, even if the lengths of the areas by corresponding double-headed arrows D in FIG. 4 are reduced to a reasonable extent, it is still possible to apply sufficient pressure to the first and second ink chambers 18*a* and 18*b*. Accordingly, since the pitch E of the first nozzle 19*a* and the second nozzle 19*b* can be made sufficiently small by reducing the length D of the ink chambers 18*a* and 18*b*, the packaging density of nozzles can be increased.

In the embodiment, the electrodes 14 are printed on the opposite surfaces of some of the green sheets 20 and, by forming the slits 16*a* to 16*d*, the electrodes 14 are separated into the first electrodes 15*a* and the second electrodes 15*b*. Accordingly, the method of the embodiment enables productivity to be improved with respect to a conventional method of printing electrodes corresponding to individual ink chambers onto piezoelectric elements.

Although a plurality of green sheets 20 are stacked to form the piezoelectric element 13, a single green sheet may be employed with the layers of electrodes.

In the above described embodiment, the piezoelectric element 13 includes green sheets 20 and electrodes 14. However there may be included a layer of substrate, for example, made of resin on the side opposite to the plate 12 so as to maintain the shape of the piezoelectric element 13 after forming the slits 16.

Although the above-described embodiment utilizes the piezoelectric element 13 which serves a piezoelectric vertical effect, a piezoelectric element having a piezoelectric lateral effect may be employed. The operation of a piezoelectric element having a piezoelectric lateral effect is as follows. Referring to FIG. 4, when a voltage is applied across the first pressure portion 17*a*, the first pressure portion 17*a* expand in the direction substantially parallel to the electrodes 15*a*, i.e., in such a direction that the slits 16*a* and 16*b* are closed. If the first pressure portion 17*a* completely closes the slits 16*a* and 16*b* and tends to expand to a further extent, it can no longer expand and is deflected in the direction indicated by the arrow C in FIG. 4. Thus, as the first ink chamber 18*a* is pressed, a jet of ink droplets is expelled from the first nozzle 19*a*.

As is apparent from the foregoing, in the presently preferred embodiment, the piezoelectric element 13 is disposed to overlie the first ink chamber 18*a* and the second ink chamber 18*b*, and the slits 16*a* to 16*d* are formed in the portion of the piezoelectric element 13 which faces ink chambers. The piezoelectric element 13 has the first pressure portion 17*a* and the second pressure portion 17*b* the areas of which are defined by corresponding ones of the slits 16*a* to 16*d*. Accordingly, since it is not necessary to mount piezoelectric element with respect to individual ink chambers one by one, the productivity of heads for ink-jet printers can be improved.

In the above-described embodiment, there are two nozzle units, each of which consists of each ink chamber, each pressure portion, each nozzle and so on, are provided in one head. However, more than two nozzle units can be provided on demand in one head in the same manner as the above-described embodiment.

Many widely different embodiments of the present invention may be constructed without departing from the spirit and scope of the present invention. It should be understood that the present invention is not limited to the specific embodiments described in this specification, except as defined in the appended claims.

What is claimed is:

1. A head for an ink-jet printer comprising:

a plurality of ink chambers arranged in parallel on a plane, a wall of each of said chambers is at least partially composed of an elastic plate disposed in parallel to said plane, said elastic plate having a side at least partially forming said wall and an opposite side;

a plurality of nozzles communicated with each of said chambers; and a piezoelectric element having a laminated structure in which at least one piezoelectric layer and at least two electrode layers sandwiching said piezoelectric layer are laminated, attached to said chambers on the opposite side of said elastic plate so as to overlie said chambers with said layers being in parallel to said plane, and including a plurality of slits which face said elastic plate and extend from said elastic plate partially into said piezoelectric element in a direction perpendicular to said plane so as to divide said laminated structure into a plurality of pressure portions in which said at least two electrode layers are electrically disconnected by said slits, each of said pressure portions being attached to one of said chambers at an area defined by said slits, each of said pressure portions pressing one of said chambers at said area by an expansion due to a piezoelectric effect when an electric voltage is applied across said electrode layers in said each of said pressure portions.

2. A head according to claim 1, wherein said piezoelectric layer comprises lead titanate zirconate.

3. A head according to claim 1, wherein said piezoelectric layer comprises a green sheet containing lead titanate zirconate.

4. A head according to claim 1, wherein said pressure portion presses said chamber by an expansion due to a piezoelectric lateral effect.

5. A head according to claim 1, wherein said pressure portion presses said chamber by an expansion due to a piezoelectric vertical effect.

6. A head according to claim 1, wherein said electrode layer comprises nickel.

7. A head according to claim 1, wherein each of said chambers comprises a recess which is formed in a container and covered by said elastic plate.

8. A head according to claim 1, wherein said chambers comprise a plurality of recesses which is formed in a single container and covered by said elastic plate.

* * * * *